US008387845B2

(12) United States Patent
Franz

(10) Patent No.: US 8,387,845 B2
(45) Date of Patent: Mar. 5, 2013

(54) SETTING TOOL

(75) Inventor: Karl Franz, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 1108 days.

(21) Appl. No.: 11/517,725

(22) Filed: Sep. 7, 2006

(65) Prior Publication Data

US 2007/0057008 A1 Mar. 15, 2007

(30) Foreign Application Priority Data

Sep. 13, 2005 (DE) ..... 10 2005 000 113

(51) Int. Cl.
*B25C 1/18* (2006.01)

(52) U.S. Cl. ..... 227/10; 227/156; 173/210

(58) Field of Classification Search ..... 227/10, 227/156; 173/210, 162; 267/140.3, 137, 267/139

See application file for complete search history.

(56) References Cited

U.S. PATENT DOCUMENTS 3,590,957 A * 7/1971 Campbell et al. ..... 184/99
4,122,904 A * 10/1978 Haytayan ..... 173/15
4,122,987 A * 10/1978 Jochum et al. ..... 227/10
4,196,833 A * 4/1980 Haytayan ..... 227/8
4,222,462 A * 9/1980 Ottestad ..... 188/67
4,384,623 A * 5/1983 Galloni ..... 173/127
4,609,135 A * 9/1986 Elliesen ..... 227/130
4,824,003 A * 4/1989 Almeras et al. ..... 227/10
5,053,701 A * 10/1991 Porkristl et al. ..... 324/207.26
5,056,701 A * 10/1991 Bereiter ..... 227/10
5,199,833 A * 4/1993 Fehrle et al. ..... 408/239 R
5,230,570 A * 7/1993 Bursey et al. ..... 384/527
5,538,172 A * 7/1996 Jochum et al. ..... 227/10
5,653,370 A * 8/1997 Bereiter et al. ..... 227/10
5,950,900 A * 9/1999 Frommelt et al. ..... 227/9
6,032,847 A * 3/2000 Ehmig et al. ..... 227/10
6,059,162 A * 5/2000 Popovich et al. ..... 227/10
6,123,242 A * 9/2000 Kersten ..... 227/10
6,123,243 A * 9/2000 Pfister et al. ..... 227/10
6,220,495 B1 * 4/2001 Jakob ..... 227/10
6,257,352 B1 * 7/2001 Nelson ..... 173/211
6,367,769 B1 * 4/2002 Reiter ..... 251/129.19
6,478,207 B2 * 11/2002 Ehmig et al. ..... 227/10
6,481,609 B2 * 11/2002 Dittrich et al. ..... 227/10
6,536,647 B2 * 3/2003 Buchel et al. ..... 227/10
(Continued)

FOREIGN PATENT DOCUMENTS

DE 3930492 A1 3/1991

*Primary Examiner* — Hemant M Desai
*Assistant Examiner* — Gloria R Weeks
(74) *Attorney, Agent, or Firm* — Abelman, Frayne & Schwab

(57) ABSTRACT

A setting tool for driving in fastening elements includes a setting piston (20) axially displaceable in a piston guide (13) which is adjoined by a bolt guide (12), and a piston stop device (30) for the setting piston (20) and arranged at an end region of the piston guide (13) adjacent to the bolt guide (12) and having a damping element (31) supported against a stop (15), and a stop member (32) for the setting piston (20) and adjoining the damping element (31) in a direction toward the piston guide (13), with the damping element (31), the stop member (32) and the stop (15) having respective surfaces (33, 34; 35, 36) arranged axially opposite each other at least one of which is formed as an inclined surface (S) forming with a respective opposite surface an angle of from 2° to 20°.

5 Claims, 4 Drawing Sheets

U.S. PATENT DOCUMENTS 6,679,411 B2 * 1/2004 Popovich et al. ..... 227/10
6,776,320 B2 * 8/2004 Sprenger et al. ..... 227/10
6,779,698 B2 * 8/2004 Lin ..... 227/130
6,779,955 B2 * 8/2004 Rivin ..... 409/234
6,857,548 B1 * 2/2005 Clark ..... 227/130
7,055,727 B2 * 6/2006 Rohrmoser et al. ..... 227/10

* cited by examiner

SETTING TOOL

BACKGROUND OF THE INVENTION

1. Field of the Invention

The present invention relates to a setting tool for driving fastening elements in a constructional component and including a piston guide having a hollow chamber, a setting piston axially displaceable in the hollow chamber of the piston guide, a bolt guide adjoining the piston guide in a setting direction of the setting tool, and a piston stop device for the setting piston and arranged at an end region of the hollow chamber adjacent to the bolt guide, with the piston stop device having a damping element supported against a stop, and a stop member for the setting piston and adjoining the damping element in a direction toward the hollow chamber of the piston guide, and with the damping element, the stop member, and the stop having respective surfaces arranged axially opposite each other.

2. Description of the Prior Art

Setting tools of the type described above can be driven with solid gaseous, fluid fuels or with compressed air. In combustion-engined setting tools, the setting piston is driven by combustion gases. With the setting piston, fastening elements, such as nails or bolts, can be driven in a constructional component.

German Publication DE 39 30 592 A1 discloses a setting tool in which a setting piston is displaceable in a piston guide displaceably arranged in a housing sleeve of the setting tool. In order to actuate the setting tool, the setting tool should be pressed against a constructional component so that the piston guide is displaced into the housing sleeve. In order to reduce the piston energy in case of a faulty setting or at an excessive energy, there is provided in the piston guide, in an end region adjacent to the piston guide, an elastic annular body that blocks the displacement of the setting piston.

The drawback of the setting tool of DE 39 30 592 A1 consists in that with an excessive wear of the elastic annular body which is not detected, essential and expensive components of the setting tool can be damaged. Further, the piston collar, which engages the annular body, should have as large diameter as possible to prevents a premature destruction of the elastic annular body. This increases the weight of the setting tool. Still further, the piston rebounds from the annular body after impacting it because of its elasticity. This, in particular at a high setting energy, can result in undesirable secondary impact applied by the piston.

German Patent DE 196 17 671 C1, from which the present invention proceeds, discloses a powder charge-operated bolt setting tool with a piston displaceable in a guide bore. The piston has a piston head and a piston stem, with the piston head having, in its region adjacent to the stem, a conical section. Opposite the conical section of the piston head, there is provided a conical receptacle at the mouth end of the guide into which the conical section can be displaced at a faulty setting or at a setting process with an excessive energy. A damping disc, which is provided behind the conical receptacle in the setting direction, damps the impact of the piston.

An extensive wear of the elastic damping disc, which takes place in a setting tool of DE 39 30 592 A1, which was discussed further above, is prevented in the setting tool of DE 196 17 671 C1. However, in the setting tool of DE 196 17 671 C1, bounce of the setting piston and, as a result, a secondary impact cannot be avoided.

U.S. Pat. No. 4,824,003 discloses a setting tool in which between the piston guide and the bolt guide, there are arranged, one after another, a first rigid ring and an elastic ring. In the elastic ring, there is arranged a further rigid ring that limits the stroke of the first more rigid ring. The first rigid ring has an opening tapering in the setting direction. The collar surface of the piston adjacent to the first rigid ring is also conical. The profiles of the conical piston surface and of the conical opening are complementary to each other.

A drawback of the setting tool of U.S. Pat. No. 4,824,003 is the same as that of DE 196 17 671 C1, namely, bouncing of the setting piston leads to secondary impacts.

Accordingly an object of the present invention is to provide a setting tool of a type discussed above in which the drawbacks of the known tools are eliminated.

Another object of the present invention is to provide a setting tool of the type discussed above in which the rebound speed of the setting piston is reduced to a minimum.

SUMMARY OF THE INVENTION

These and other objects of the present invention, which will become apparent hereinafter, are achieved by providing a setting tool in which one of the respective axially opposite surfaces of the elastic element, the stop member, and the stop is formed as an inclined surface forming with a respective opposite surface an angle of from 2° to 20°.

With one of respective cooperating surfaces forming an angle with a surface it cooperates with, excessive setting energy leads to an increase surface friction of the piston stem with the through-guide surface of the stop member and, thereby, to an increase reduction of the setting energy. Simultaneously, rebound of the piston is prevented to a most possible extent.

Advantageously, an angle, which the inclined surface forms with the opposite surface, lies within a range from 6° to 10°.

According to one advantageous embodiment of the inventive setting tool, the inclined surface is formed by a surface of the stop member. Because the stop member, which preferably is formed of metal such as, e.g., steel and is produced by turning, the inclined surface can be formed with a minimum of additional costs.

According to another advantageous embodiment of the present invention, the inclined surface is formed by a surface of the damping element. The complicated shape of the damping element, which is formed of an elastomer, practically, does not involve additional costs, as the entire part is formed by injection molding. Therefore, this embodiment can be economically produced. A further advantage of this embodiment consists in that the gravity center of the stop member is centrally located so that the setting piston is not subjected to bending stresses at first contact.

In addition to physically forming an inclined surface on the damping element, also, there can be contemplated an eccentric distribution of the rigidity of the elastomer the damping element is made of.

According to a still further embodiment of the present invention, the inclined surface is formed on a stop provided on the bolt guide. The bolt guide, which preferably is made of metal such as, e.g., steel, is formed by turning and milling. Thus, the inclined surface can be produced with very little additional costs.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
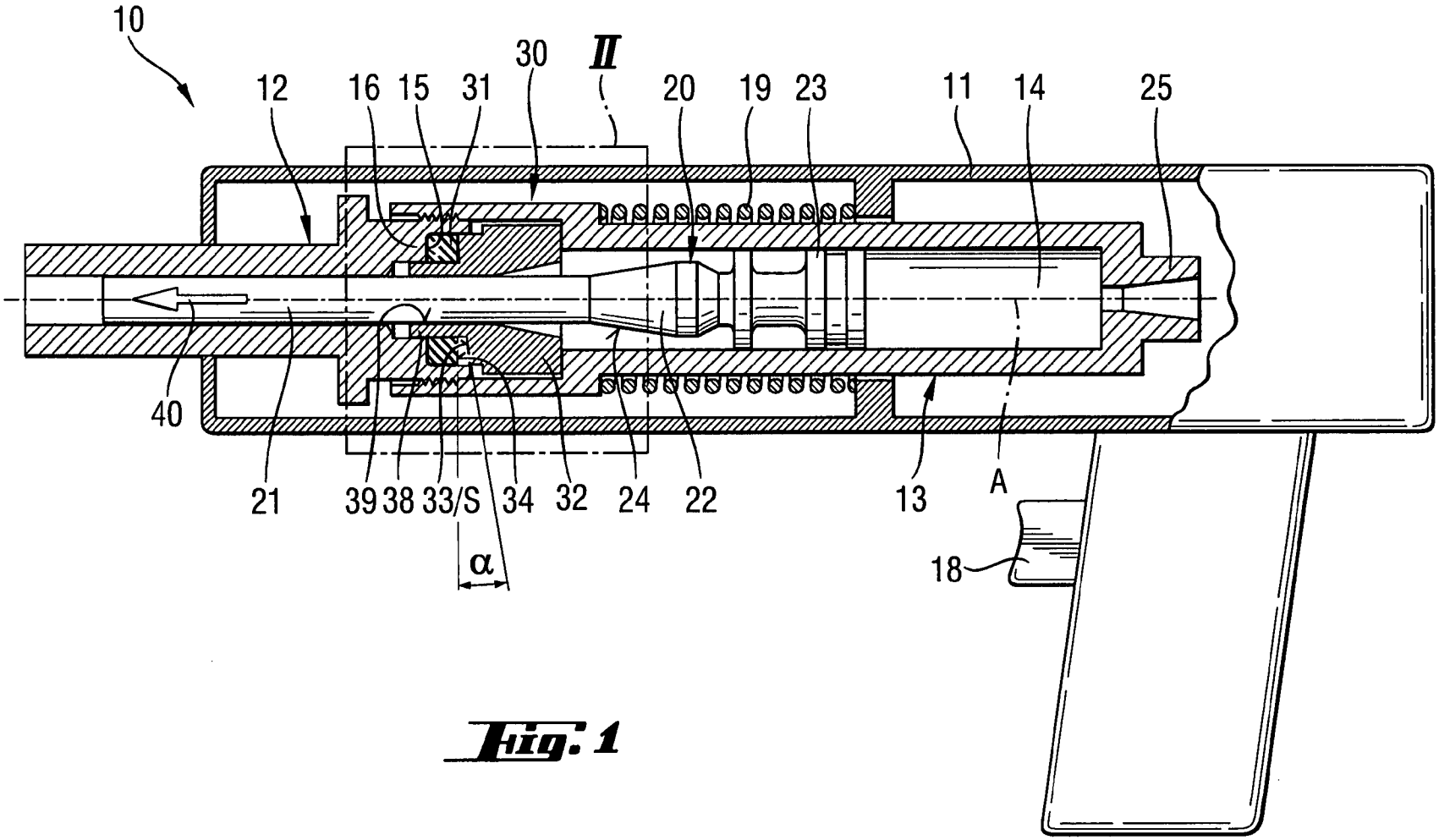
FIG. 1 a side, partially cross-sectional view of a setting tool according to the present invention with a piston stop device.
Figure 2:
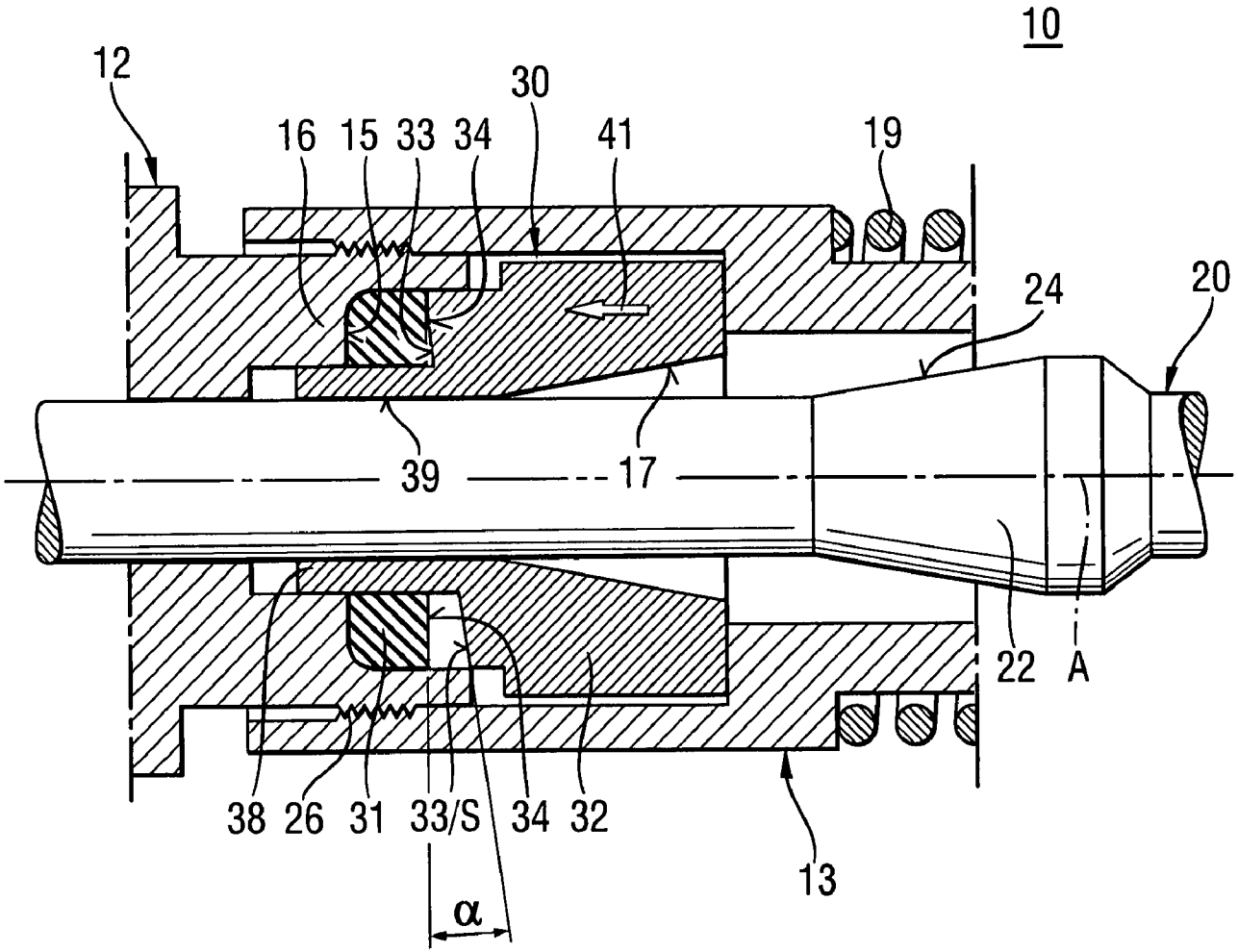
FIG. 2 a section of the setting tool shown in FIG. 1 and designated with marking II in FIG. 1 at an increased, in comparison with FIG. 1, scale.

A setting tool 10 according to the present invention, which is shown in FIGS. 1-2, includes a piston stop device generally designated with a reference numeral 30. The setting tool 10 further includes a piston guide 13 which is arranged in one- or multi-part housing 11. The piston guide 13 has a hollow chamber 14 in which a setting piston 20 is displaceably arranged. The piston 20 is driven by a propellant or its reaction products, e.g., combustion gases or the like. The setting piston 20 has a piston stem 21 that adjoins, in a setting direction 40 of the setting tool 10, a piston head 23. On the piston stem 21, there is provided a piston collar 22 spaced from the piston head 23. The piston collar 22 has a counter-stop surface 24 extending in a direction of the piston stop device 30 and formed, in the embodiment of the setting tool 10 shown in the drawings, as a conical surface. The piston collar 22 can have a shape different from that shown in the drawings but is always arranged directly in the region of the piston 20 extending in the setting direction 40. The piston guide 13 is displaceably supported in the sleeve-shaped housing 11 and is supported thereagainst by a spring 19. At the end of the piston guide 13 facing in a direction opposite the setting direction, there is provided a cartridge receptacle for receiving a propellant charge, e.g., in form of a cartridge, pellet, or blister.

A setting process with a setting tool 10 can only then be initiated when the setting tool 10 engages a constructional component, not shown, with a bolt guide 12 that adjoins, in the setting direction 40, the piston guide 13. The bolt guide 12 is connected with the piston guide 13 at an interface 26 which is formed, e.g., as a thread section. For actuation of the setting tool 10, there is provided an actuation switch 18.

At the end of the piston guide 13 adjacent to the bolt guide 12, there is arranged the above-mentioned piston stop device 30. The piston stop device 30 is supported against a stop 15 which is formed by a surface of a receptacle 16 of the bolt guide 12. In the embodiment shown in FIG. 1, the piston stop device 30 has a damping element 31 formed as an elastomer ring, and a stop member 32 formed as a metal sleeve. The stop member 32 has a first surface 33 adjacent to the damping element 31 and formed as an inclined surface S. The inclined surface S is inclined at an angle $\alpha$ of 8°. with respect to the opposite second surface 34 on the damping element 31. The surface 34 on the damping element 31 extends substantially perpendicular to setting axis A of the setting tool 10 and defined by the setting piston 20.

The damping element 31 can be pinned on a cylindrical section 38 of the stop member 32. In this way, the stop member 32 is supported by the damping element 31, indirectly, against the stop 15 of the bolt guide 12, with a possibility of being elastically damped thereagainst.

At its end remote from the bolt guide 12, the stop member 32 has a stop surface 17 that is formed, in the embodiment shown in the drawings, as a conical surface against which the setting piston 20 can bounce with its counter-stop surface 24 that is formed by the piston collar 22. The piston stop device 30 brakes the displacement of the setting piston 20 when the piston 20 is rapidly displaced because of error setting or because of a two strong propellant. The counter-stop surface 24 is formed as a complimentary surface to the stop surface 17 and, thus, is formed in the embodiment shown in the drawings also as a conical surface. The stop member 32 also has a cylindrical through-guide 39 through which the stem 21 of the setting piston 20 is extendable.

When the setting piston 20, upon being displaced in the setting direction 40, impacts the stop member 32, the stop member 32 is pressed in the direction of arrow 41 against the elastic damping element 31, the damping element 31 is compressed. The inclined first surface 33 of the stop member 32 is pressed against the second surface 34 of the damping element 31, whereby the stop member 32 tilts. Thereby, when the setting process is conducted with an excessive energy, with which the setting piston 20 impacts the stop member 32, the friction of the piston stem 21 in the through-guide 39 increases, which leads to an increased reduction of energy. Simultaneously, a rebound of the setting piston 20 is prevented to a most possible extent.

Figure 3:
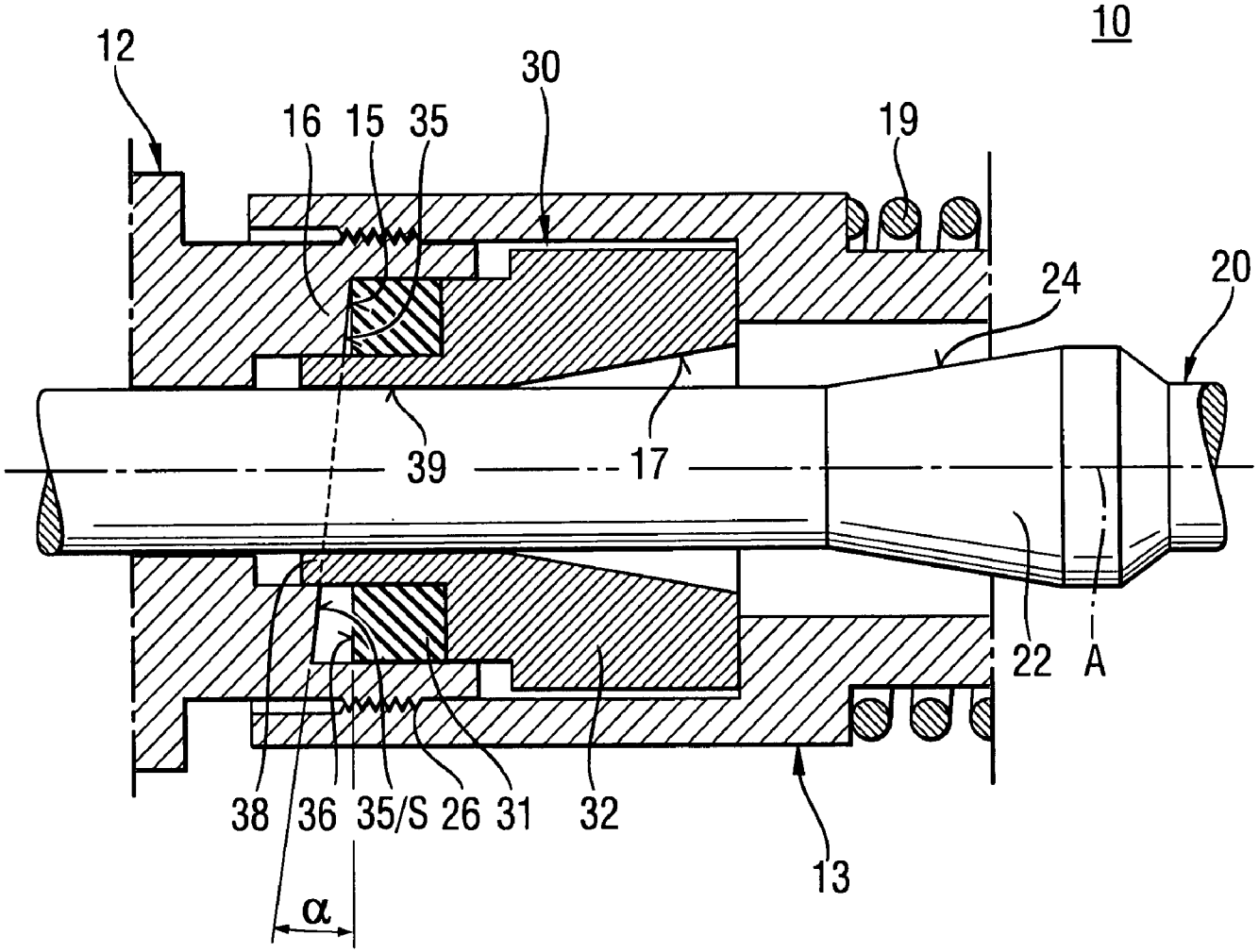
FIG. 3 a section similar to that of FIG. 2 of another embodiment of a setting tool according to the present invention.

A setting tool 10, which is shown in FIG. 3, differs from the setting tool described above, in that the inclined surface S is formed by a third surface 35 provided on the stop 15. The third surface 35 is located opposite a fourth surface 36 provided on the damping element 31. The angle $\alpha$ between the third surface 35 and the fourth surface 36 here also amounts to 8°. The inclined surface S likewise provides here for an increased surface friction of the setting piston 20 in the through-guide 39 of the stop member 32 and in the damping element 31. Thereby, the rebound of the setting piston 20 is likewise prevented here to a most possible extent.

Figure 4:
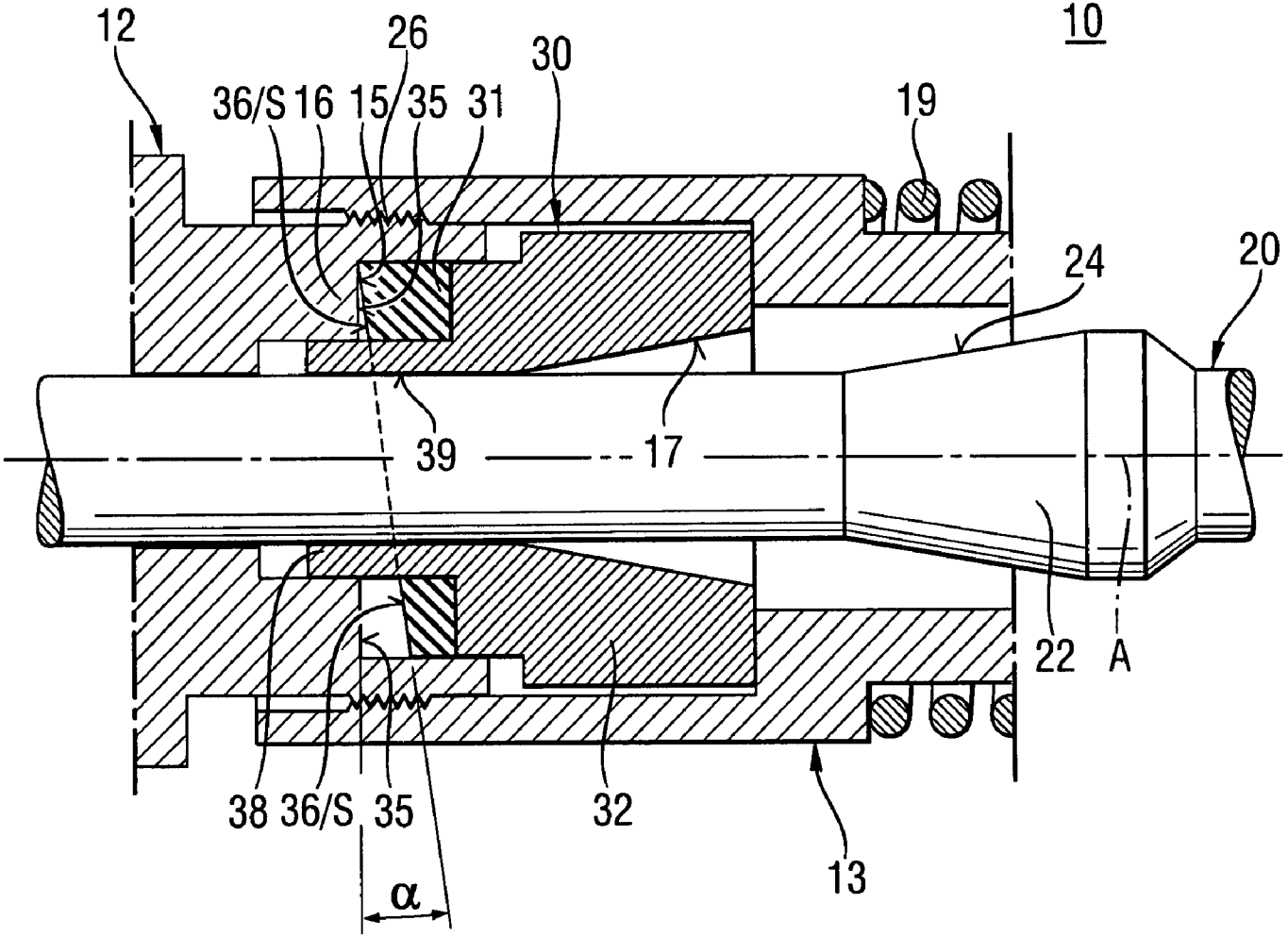
FIG. 4 a section similar to that of FIGS. 2-3 of yet another embodiment of a setting tool according to the present invention.

The setting tool 10, which is shown in FIG. 4, differs from the setting tools described above in that the inclined surface S is formed by the fourth surface 36 provided on the damping element 31. The fourth surface 36 is located opposite the third surface 35 on the stop 15. The angle $\alpha$ between the third surface 35 and the fourth surface 36 amounts here also to 8°. Here also the inclined surface S provides for an increased surface friction of the setting piston 20 in the through-guide 39 of the stop member 32 and the damping element 31, and the rebound of the setting piston 20 is likewise prevented here to a most possible extent.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving fastening elements into a constructional component, comprising:

a piston guide (13) having a hollow chamber (14);

a setting piston (20) axially displaceable in the hollow chamber (14) of the piston guide (13) for driving the fastening elements into the constructional component;

a bolt guide (12) adjoining the piston guide (13) in a setting direction of the setting tool for guiding the fastening elements; and a piston stop device (30) arranged at an end region of the hollow chamber (14) adjacent to the bolt guide (12) for controlling the axial displacement of the setting piston (20) when the setting piston (20) drives the fastening elements into the constructional component, with the piston stop device (30), the piston stop device (30) having:

a damping element (31) supported against a stop (15), and a stop member (32) for the setting piston (20) and adjoining the damping element (31) in a direction toward the hollow chamber (14) of the piston guide (13), wherein each of the damping element (31), the stop member (32), the stop (15), have respective surfaces (33, 34, 35, 36) arranged axially opposite each other, with at least one of the respective, axially opposite surfaces (33 and 34, 35 and 36) being formed as an inclined surface (S) enclosing a respective opposite surface such that an angle (α) between at least one of pairs (33, 34) and (35, 36) of axially opposite surfaces (33 and 34, 35 and 36) is formed, and wherein the angle (α) is in a range of 2° to 20°.

2. A setting tool according to claim 1, wherein the inclined surface (S) forms with the opposite surface the angle α in a range of 6° to 10°.

3. A setting tool according to claim 1, wherein the inclined surface (S) is formed by a surface (33) provided on the stop member (32).

4. A setting tool according to claim 1, wherein the inclined surface (S) is formed by a surface (36) provided on the damping element (31).

5. A setting tool according to claim 1, wherein the inclined surface (S) is formed by a surface (35) provided on the stop (15).

* * * * *